US006979108B1

(12) United States Patent
Berge

(10) Patent No.: US 6,979,108 B1
(45) Date of Patent: Dec. 27, 2005

(54) MULTI-USE ADAPTOR KIT/SYSTEM FOR RECESSED CAN FIXTURES

(76) Inventor: Arthur J. Berge, 41181 Breckin Ct., Murrreta, CA (US) 92562-6016

( * ) Notice: Subject to any disclaimer, the term of this patent is extended or adjusted under 35 U.S.C. 154(b) by 161 days.

(21) Appl. No.: 10/669,008

(22) Filed: Sep. 24, 2003

Related U.S. Application Data

(60) Provisional application No. 60/412,851, filed on Sep. 24, 2002.

(51) Int. Cl.[7] ..... F21V 17/00
(52) U.S. Cl. ..... 362/442; 362/147; 362/404; 362/405
(58) Field of Search ..... 362/442, 403, 362/404, 405, 418, 429, 285, 372, 364, 365, 362/457, 145, 147, 148, 226, 362, 430

(56) References Cited

U.S. PATENT DOCUMENTS

| | | | | |
|---|---|---|---|---|
| 5,075,831 | A * | 12/1991 | Stringer et al. | 362/365 |
| 5,440,471 | A * | 8/1995 | Zadeh | 362/365 |
| 5,707,143 | A * | 1/1998 | Hentz | 362/365 |
| 5,823,664 | A * | 10/1998 | Demshki et al. | 362/366 |
| 6,168,298 | B1 * | 1/2001 | Hentz et al. | 362/365 |

* cited by examiner

*Primary Examiner*—John Anthony Ward
*Assistant Examiner*—Adam C. Rehm

(57) ABSTRACT

An adaptor kit or system for use with conventional can light fixtures to adapt the can light fixture for use as a hanger assembly for ceiling fans, for example, includes a spider plate that is hung onto the can height adjustment screws and a mounting plate to which a cross-bar or other mounting hardware is attached. Adjustment screws are adjusted to control the distance between the spider plate and the mounting plate.

20 Claims, 13 Drawing Sheets

MULTI-USE ADAPTOR KIT/SYSTEM FOR RECESSED CAN FIXTURES

CROSS-REFERENCE TO RELATED APPLICATION

This application claims the benefit of U.S. Provisional Patent Application 60/412,851 filed Sep. 24, 2002 by the applicant herein.

The present invention relates to an adaptor or conversion kit or system for use with "can light" or "can fixture" assemblies to adapt the can light for other uses, including, for example, use as a hanger for a ceiling fan, a depending or hanging lamp, or a flush-mount lamp.

BACKGROUND OF THE INVENTION

The present invention relates to recessed ceiling lighting fixtures of the type that are located within or recessed within a ceiling. A light bulb or lamp is located within the housing and is positioned so that the lowermost point of the lamp is somewhat above, flush with, or slightly below the ceiling. Lighting fixtures of this type, also known as "can lights" or "can fixtures," are well known in both new construction and in retrofit situations due, in part, to the unobtrusive nature of the fixtures themselves and of their desirable illumination pattern.

A representative example of a "can light" assembly of the type used in new construction is shown in side elevation view in FIG. 1 and is designated therein by the reference character 10. The particular organization and structure shown is exemplary only and is representative of a wide variety of can light fixtures marketed by various manufacturers. As shown, the fixture 10 includes a frame or frame-like pan structure 12 which mounts an electrical junction box 14 and a can 16. The can 16 and the junction box 14 are connected by a standard conduit 18 through which insulated wiring (not shown) extends from the junction box 14 to the interior of the can 16 to provide power to a lamp (not shown) within the can 16. The frame structure 12 is mounted by adjustable hanger bar assemblies 22 (only one of which is shown) between joists (not shown) above a ceiling in which an opening is formed.

The can 16 is typically formed from thin-walled metal, such as aluminum, that is pressed into shape, and includes a cylindrical can body 24 and a dome-shaped cap 26; in some designs the can 16 is formed as a 1-piece component. The can 16 is designed to be moved or adjusted vertically (i.e., along the up/down axis) throughout a limited range of motion in its frame 12. As shown in FIG. 1 and in FIG. 2, the can 16 is formed with a plurality of up/down slots 28 (typically, three). As shown in the detail of FIG. 2, a threaded fastener 30 (typically a sheet-metal or similar screw) is passed through its slot 28 on the interior side of the can 16 to engage a screw-receiving hole in the frame 12. When all of the adjustment screws 30 are loosened, the can 16 can be moved up or down in its frame pan 12 to the desired position and the adjustment screws 30 thereafter tightened to hold the can 16 in the proper position. In FIGS. 1–3, the size of the heads of the fasteners 30 is shown disproportionately large for reasons of clarity.

As also shown in FIG. 1, a lamp socket assembly 32 is mounted on an "L"-shaped bracket 34 and held in position by a wing nut 36 and a clamping screw (not specifically shown) that extends through a slot formed in the vertical portion of the bracket 34. When the wing nut 36 is loosened, the bracket 34 (and the lamp socket assembly 32) can be moved up or down to a desired position. Electrical wires (not shown) extend from the socket assembly 32 through an opening (not specifically shown) and through the conduit 18 to the junction box 14 as described above.

In a normal or typical installation, a lamp (not shown) is threaded into the socket 32 to provide illumination. In the case of the present invention and as shown in FIG. 1, a screw-type "adaptor" 38 (dotted-line illustration) is threaded into the socket 32 in lieu of a conventional light bulb. A pair of wires W1 and W2 extend from the adaptor 38 and provide power as explained below.

Can light fixtures of the type described above are in common usage and perform their lighting function as intended. However and because can light fixtures are "single function" devices, they lack a certain flexibility for use in related functions, such as a support for a ceiling fan, a support for a hanging or suspended lamp or lamp fixture, and a support for a flush-mounted ceiling lamp.

SUMMARY OF THE INVENTION

In view of the above, it is an object of the present invention, among others, to provide an adaptor kit or system for use with conventional can light fixtures to adapt the can light fixture for use as a hanger assembly for ceiling fans, to adapt the can light fixture for use as a hanger for hanging or suspended lamps, including chandeliers, and to adapt the can light assembly for other types of non-recessed lamps, including flush-mounted lamps.

In accordance with these objects, and others, the present invention provides an adaptor kit for can light fixtures having an adaptor plate designed to engage with and be mounted upon the can-height adjustment screws. The adaptor plate includes adjustable spacer posts, typically in the form of threaded screws, that position a second plate relative to the adaptor plate. A threaded tube extends between the second plate and the adaptor plate to mechanically connect the two plates and serve as a conduit for electrical wires. The second plate is adapted to accept a cross-bar, or other mounting hardware, from a ceiling fan, a hanging lamp, or a flush-mounted lamp that can then be mounted to the adaptor kit to thus increase the utility and usefulness of can light fixtures.

The present invention advantageously provides an adaptor kit system for use with can light assemblies to increase the usefulness of those assemblies.

Other objects and further scope of applicability of the present invention will become apparent from the detailed description to follow, taken in conjunction with the accompanying drawings, in which like parts are designated by like reference characters.

DESCRIPTION OF THE INVENTION

Figure 2:
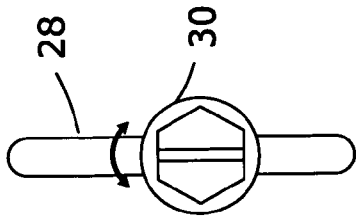
FIG. 2 Prior Art
FIG. 2 is a partial elevational view of a representative adjustment screw and related structure used for adjusting the height of a can.
Figure 1:
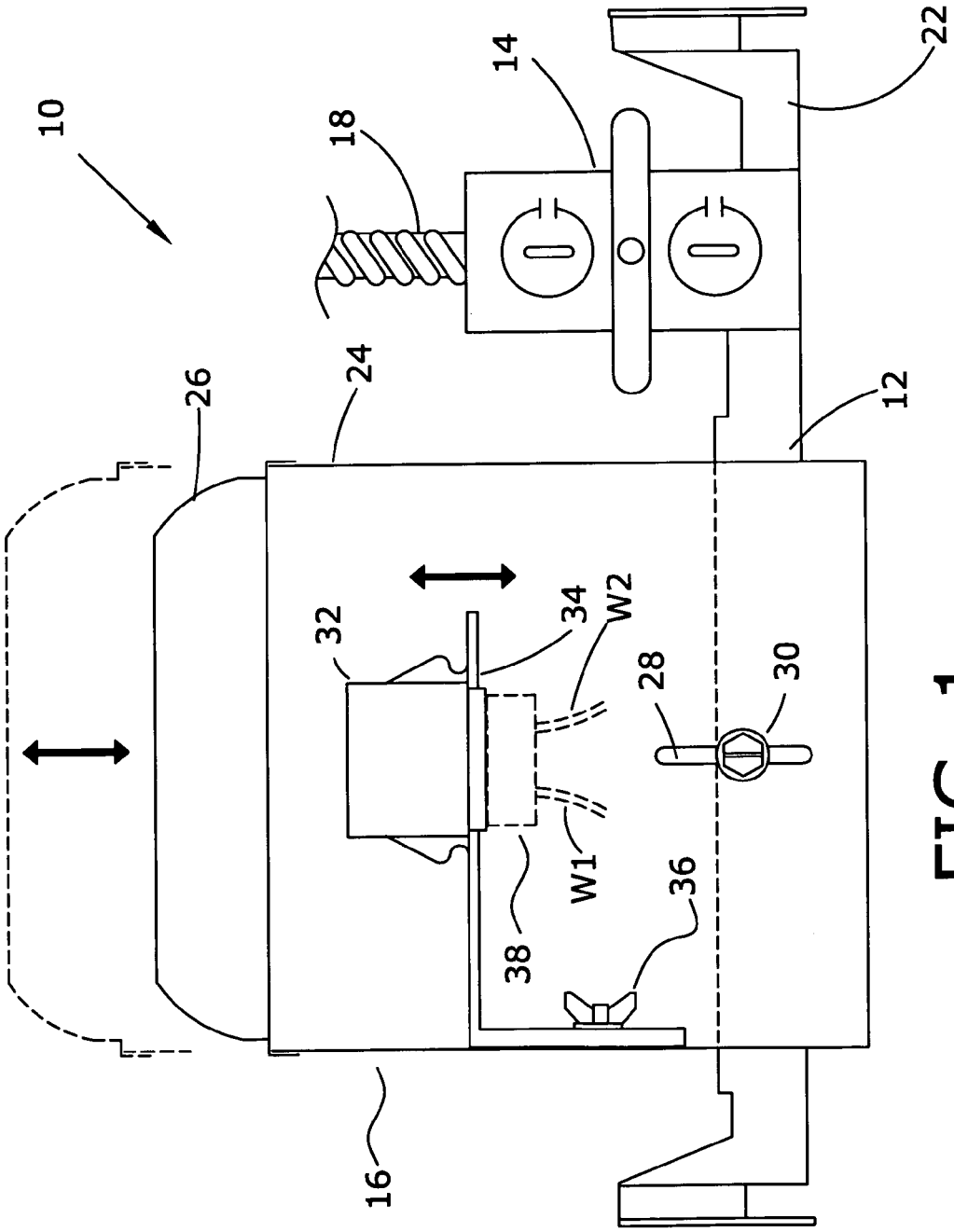
FIG. 1 Prior Art
FIG. 1 is a side elevational view, in partial cross-section, illustrating a representative recessed downlighting fixture to which the present invention is intended to be adapted.
Figure 3:
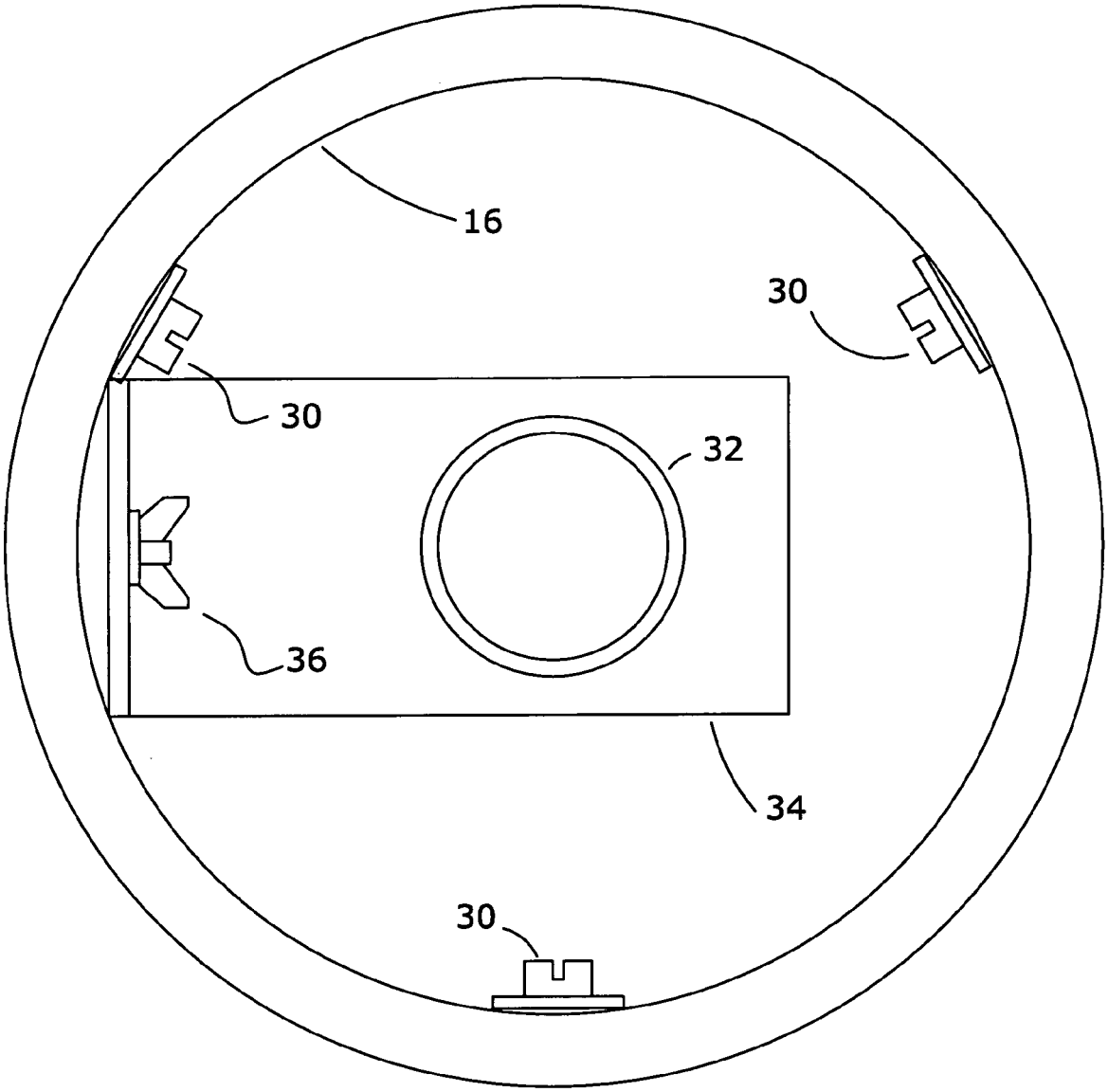
FIG. 3 Prior Art
FIG. 3 is a bottom view of the interior of the can.

An adaptor kit system for use with can light fixtures of the type shown in FIGS. 1–3 is shown as a preferred "offset" embodiment in FIGS. 4–8 and as a second embodiment in FIGS. 11–15. In each of these set of figures, the same reference character is used to designate common parts.

Figure 4:
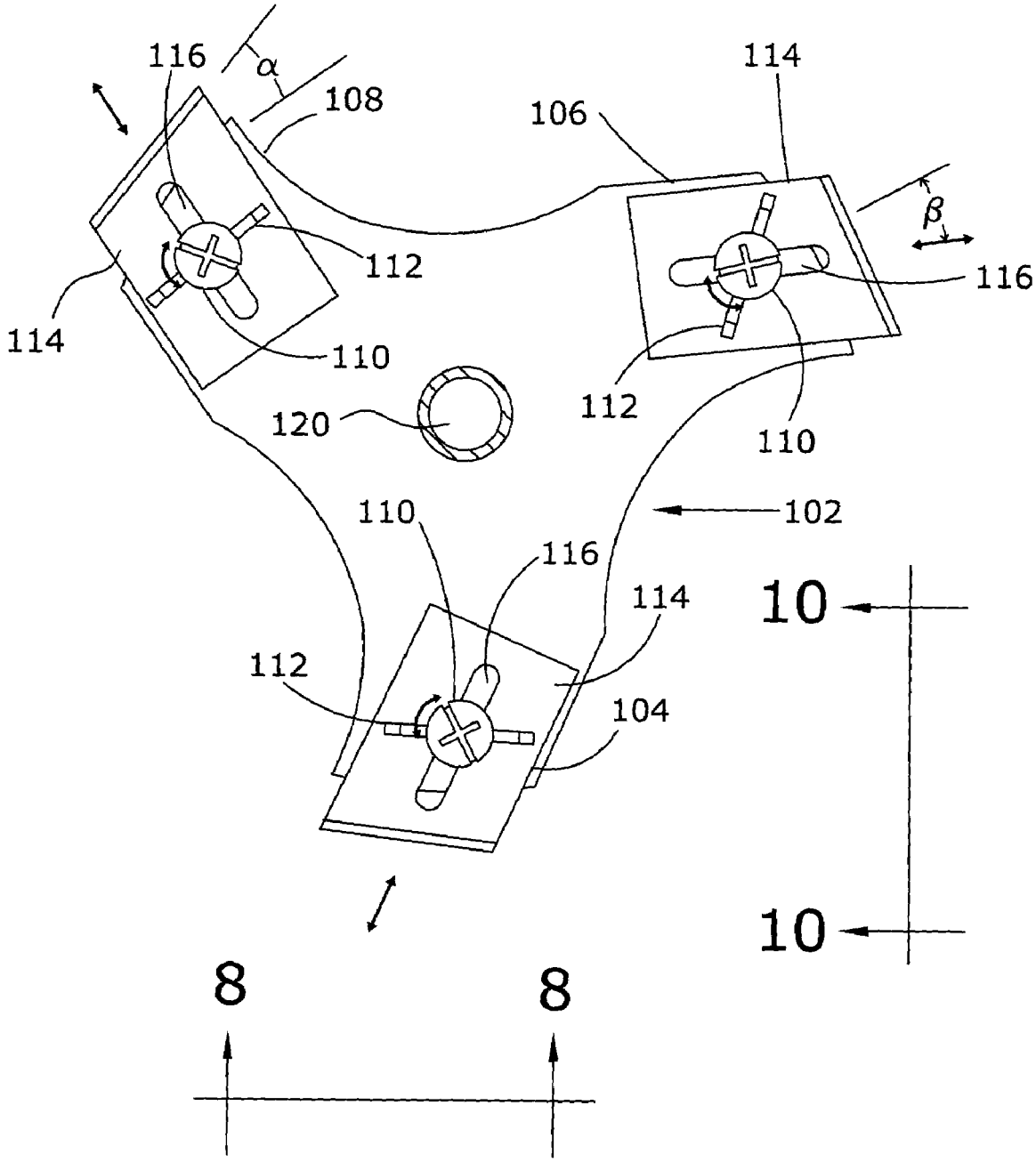
FIG. 4 is a bottom view of a preferred "offset" adaptor mounting plate system of the present invention.
Figure 5:
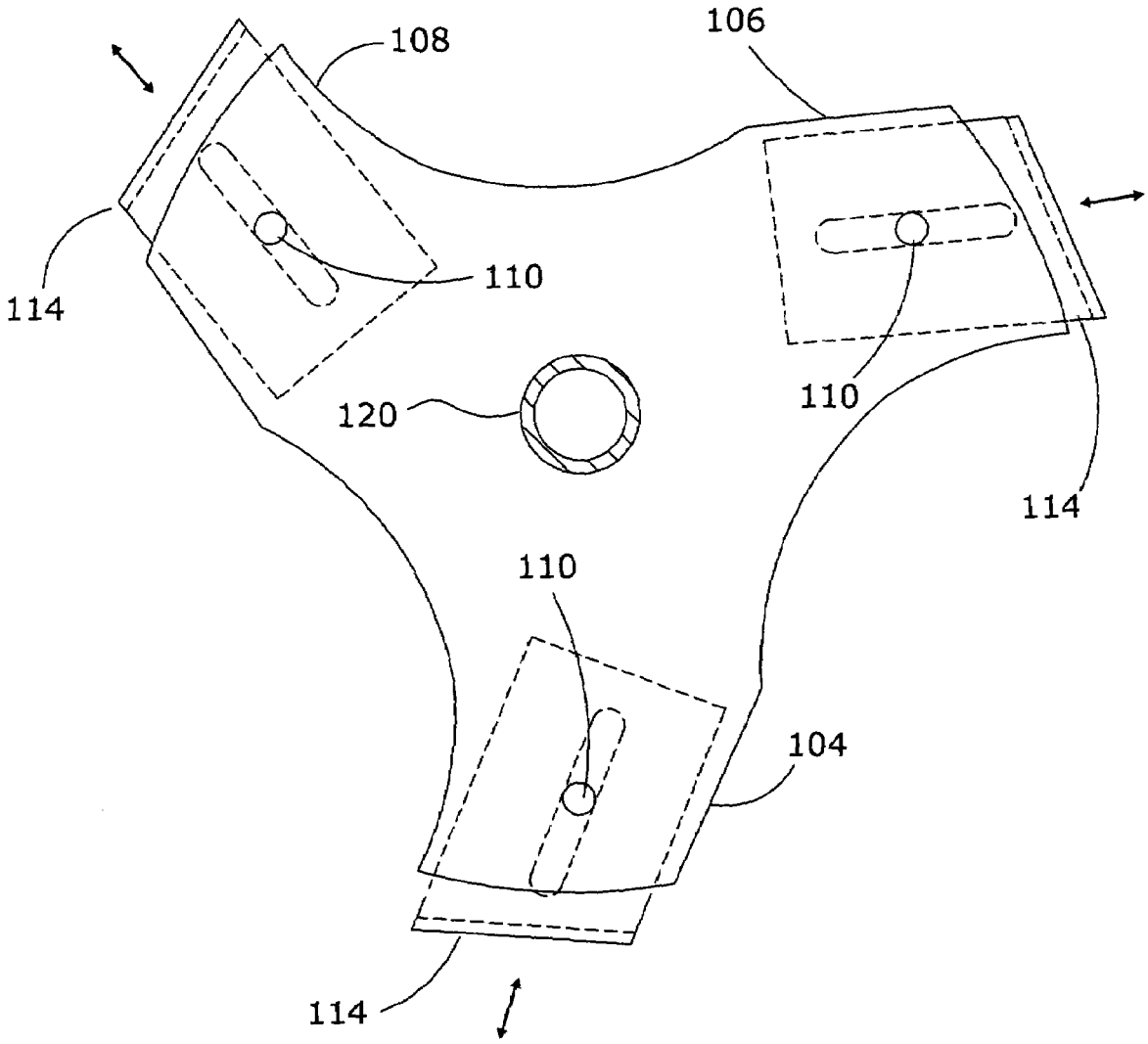
FIG. 5 is a top view of the preferred "offset" adaptor mounting plate system of FIG. 4.

As shown in the underside view of FIG. 4 and the top view of FIG. 5, the preferred "offset" embodiment of the adaptor kit includes a mounting or spider plate 102 having three spaced-apart legs 104, 106, and 108 extending generally outward of a central portion or area of the spider plate 102. The spider plate 102 can be defined as having a major radius dimension from a center thereof such that the entire spider plate 102 can fit within the interior portion of a can light fixture. In general, the spider plate 102 can be dimensioned so that it will fit within a 5-inch opening thus allowing use with so-called "5-inch" and "6-inch" can lights. The spider plate 102 can be formed, for example, from die-stamped sheet steel, and, if desired, stiffening ribs (not shown) can be formed in the spider plate 102.

Figure 10:
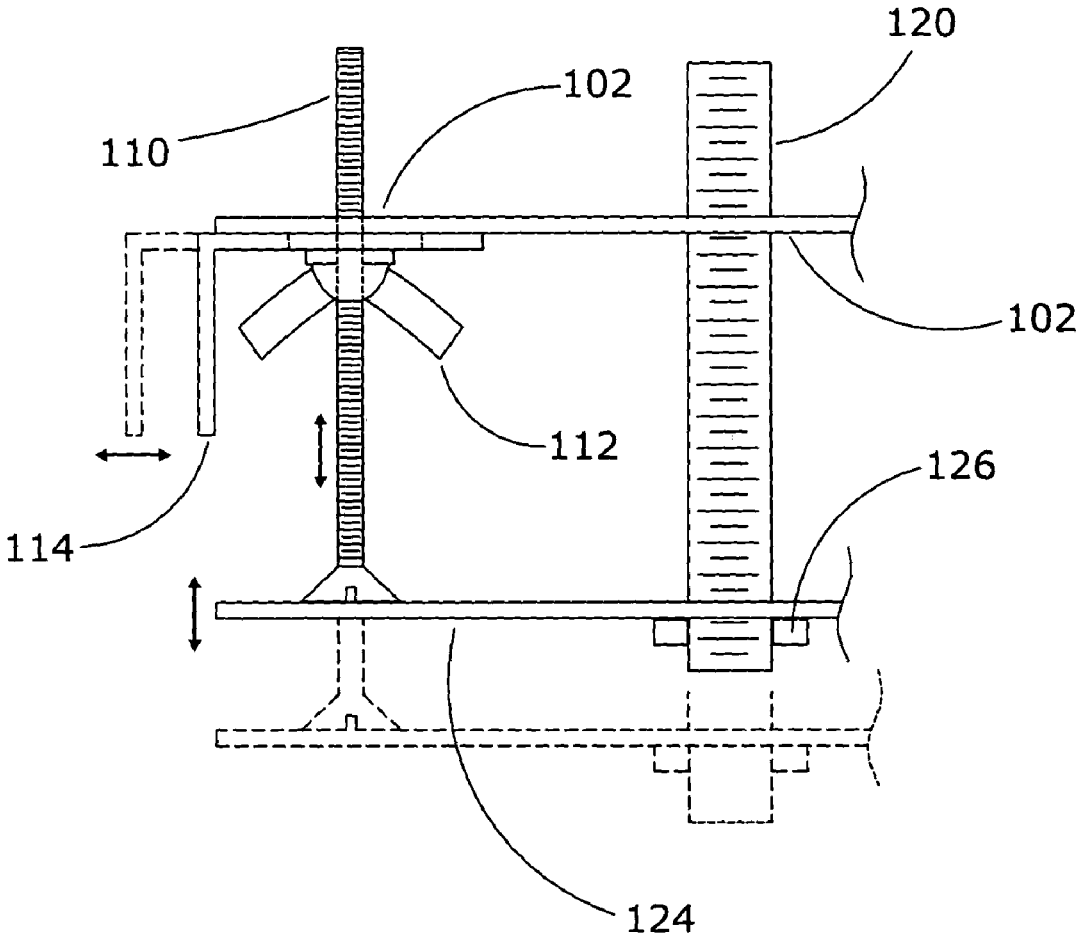
FIG. 10 is a side view of the mounting leg taken along line 10—10 of FIG. 4.

Each of the legs 104, 106, and 108 includes an internally threaded hole (unnumbered) that accepts an adjustment screw 110, a locking nut 112 associated with each adjustment screw 110, and a bracket 114 that is held in place against the spider plate 102. As shown in FIGS. 4 and 10, each adjustment screw 110 is preferably a flat-head screw (although other screw-head configurations are equally suitable) and can be rotated in one direction or the other to change the distance "D" between the underside of the spider plate 102 and the remote or distal end of the screw head. Once the distance dimension "D" is established, the locking nut 112 is tightened to lock the adjustment screw 110 in place. As shown, a wing nut is the preferred embodiment of the locking nut 112, although other types of nuts, including those tightened with some type of wrench or tool can be used. As can be appreciated, the lowermost ends of the screws 110 form a plane that is spaced a selected distance from and preferably substantially parallel to the spider plate 102.

Each bracket 114 is preferably formed from a rectangular sheet-steel strip having a major axis along the length of the strip with the downwardly extending portion formed by bending the strip along a minor axis line formed at an angle $\alpha$ (FIG. 4) relative to the major axis of the strip; an acceptable bend-line angle being about 20° or so. The bracket 114 includes a first slot 116 generally aligned along or relative the major axis of the bracket 114 and through which its adjustment screw 110 passes and which allows, as indicated by the bidirectional arrows in FIGS. 4 and 5, outward (or inward) positioning of the bracket 114 by the installer. Once the position of each bracket 114 is established (as explained in more detail below), its locknut 112 can be tightened to both fix the position of the bracket 114 and lock its adjustment screw 110 from further motion.

Figure 8:
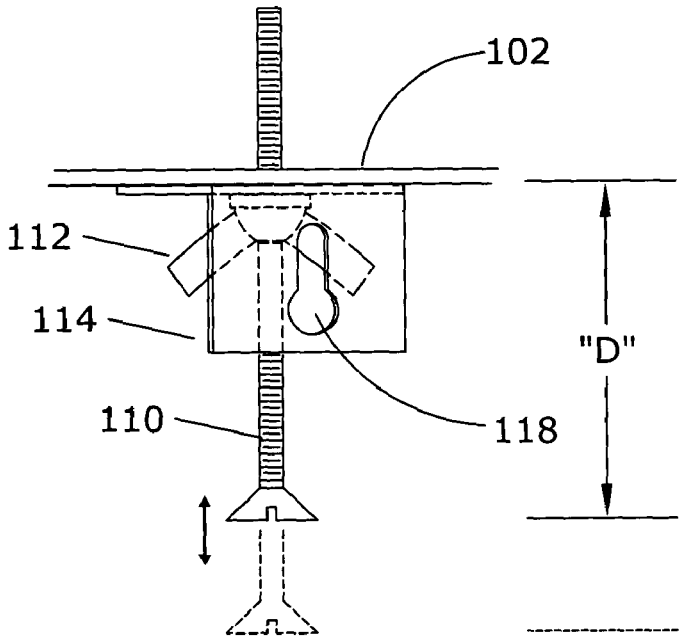
FIG. 8 is a detailed view of an "offset" mounting leg taken along line 8—8 of FIG. 4.
Figure 9A:
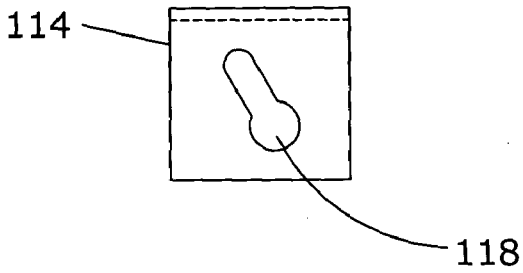
FIG. 9*a* illustrates a first variant of the mounting leg in which a "keyhole" mounting slot is shown at an off-vertical orientation.
Figure 9B:
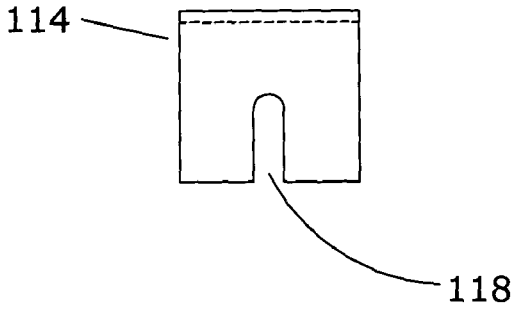
FIG. 9*b* illustrates another variant of the mounting leg in which an open-ended slot is used.

As shown in FIG. 4 (at leg 106) the slot 116 is aligned for inward and outward movement along an axis that does not pass through the center of the spider plate 102; the offset angle $\beta$ being about 20°. Each bracket 114 includes, on its depending leg, a second slot 118 (see FIG. 8) that is designed to engage one of the can-height adjustment screws 30 (FIGS. 1 and 2) to mount the spider plate 102 and the related parts of the adaptor kit into the can 16 as described below. As shown in FIG. 8, the slot 118 is preferably formed as a vertically aligned "keyhole" slot dimensioned so that the head of the can-height adjustment screw 30 can pass through the enlarged diameter dimension of the keyhole slot 118. As shown in FIG. 9*a*, the slot 118 need not be vertically aligned, i.e., it can be aligned along an off-vertical axis, and, as shown in FIG. 9*b*, the slot 118 can include other configurations, such as an open-ended slot that is vertically or off-vertically aligned, for example.

As shown in FIG. 10, a standard-sized externally threaded pipe 120 (e.g., ⅛-IP or ¼-IP) is threaded into an internally threaded hole (unnumbered) formed in the center of the spider plate 102. The threaded pipe 120 is hollow so that the electrical wires W1 and W2, mentioned above, can be passed through the pipe 120, as explained in more detail below.

Figure 7:
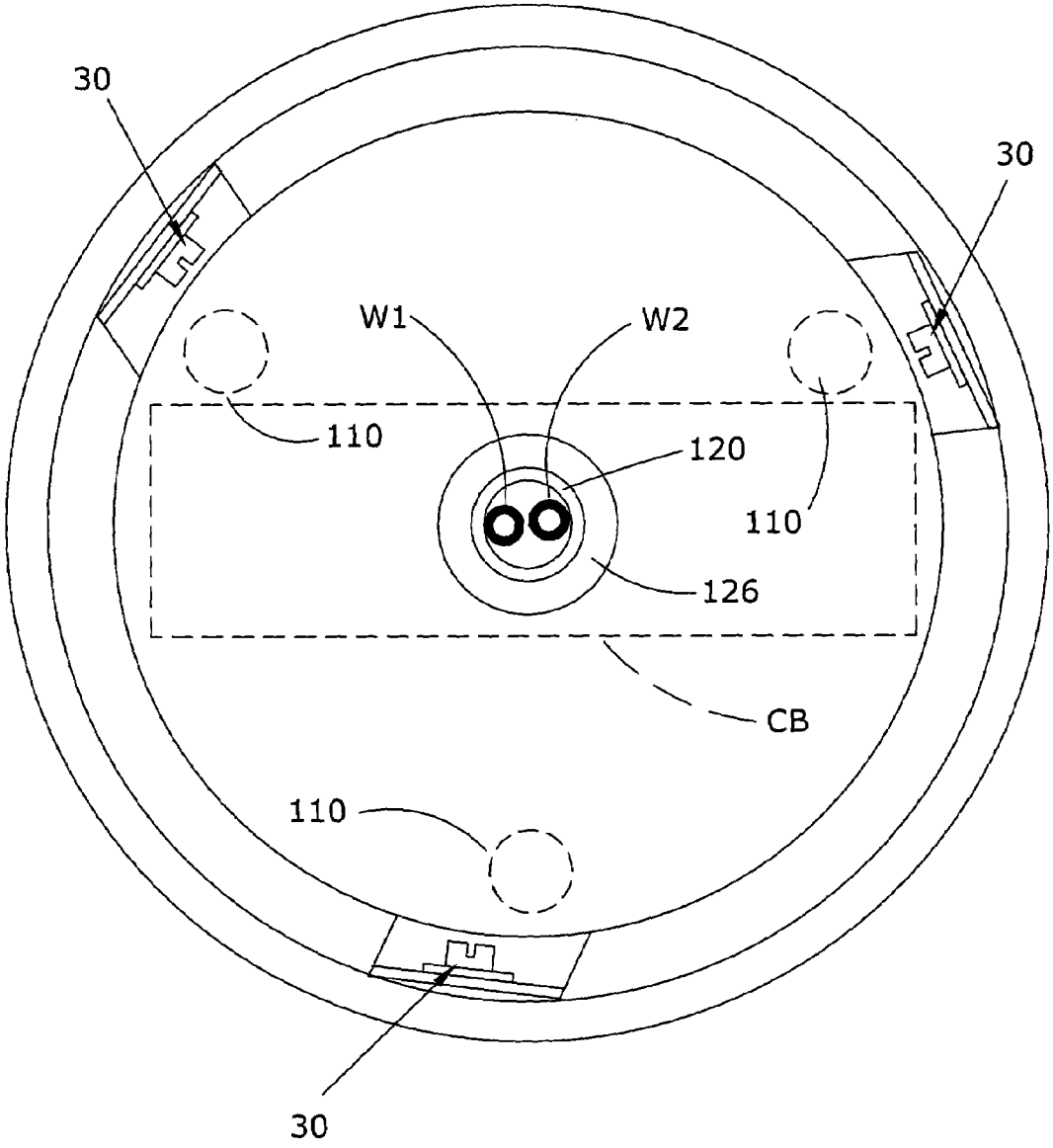
FIG. 7 is a bottom view of the can of FIG. 6 with a mounting plate installed.

The adaptor kit 100 includes a mounting plate 124 (FIG. 10) that includes a internally threaded hole (unnumbered) formed in the center thereof and through which the threaded pipe 120 is threaded. As is also shown in FIG. 10, a lock sleeve 126 (or equivalent nut) is also threaded on the threaded pipe 120 to lock the threaded pipe 120 in position relative the mounting plate 124. While not specifically shown, an additional locking sleeve (or equivalent nut) can be used to lock the threaded pipe 120 against the spider plate 102. In general, the mounting plate 124 is provided with a plurality of internally threaded holes in different positions so the vast majority of mounting hardware from the manufacturers of various hanging or depending lamps, flush-mounted lamps, and/or ceiling fans have a high probability of having appropriately positioned/sized mounting holes in the mounting plate 124. In FIG. 7, an example cross-bar CB, typically used to install a hanging fan, is shown in cross-section.

Figure 6:
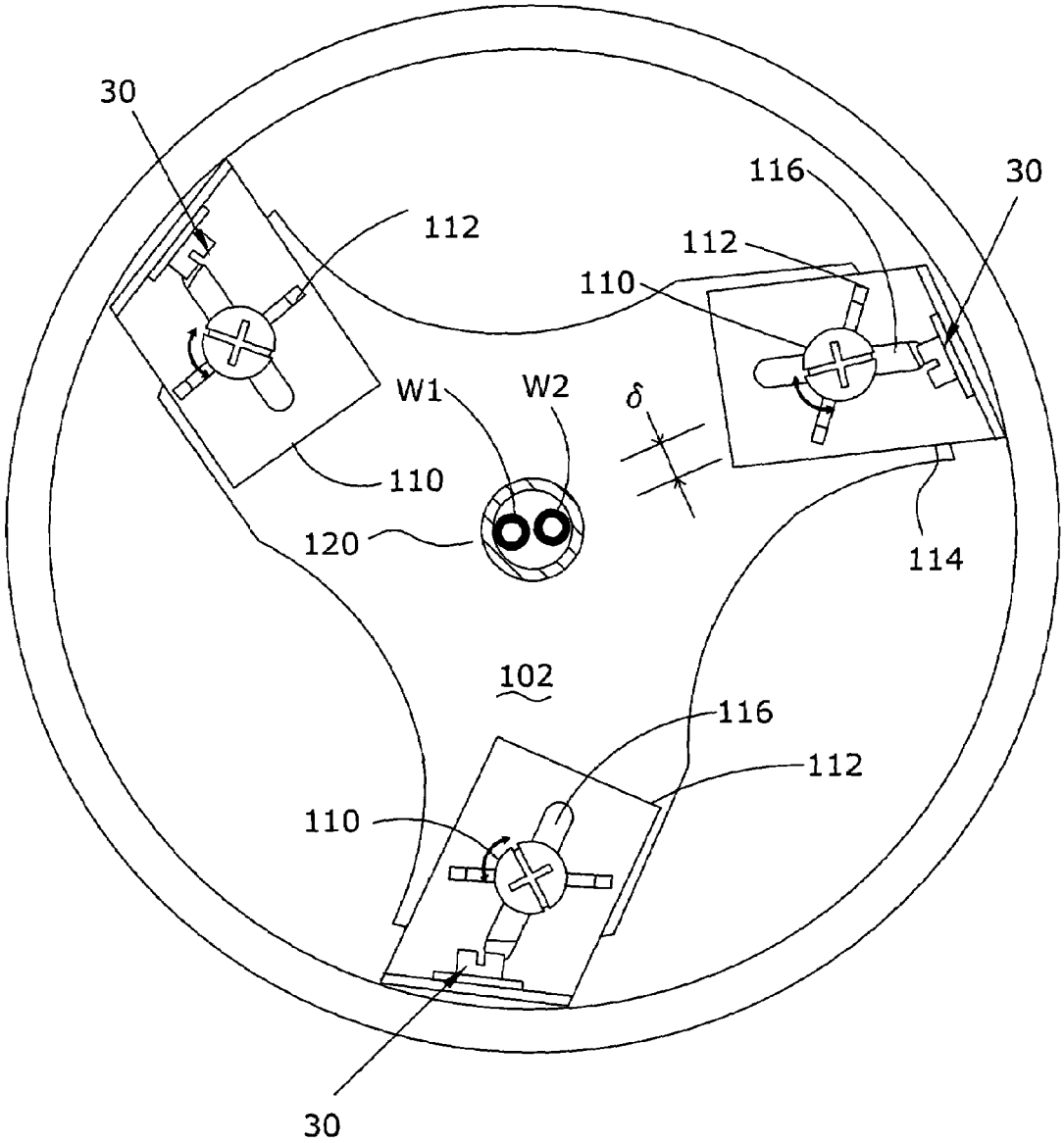
FIG. 6 is a bottom view of a can with the "offset" adaptor mounting plate system of FIG. 4 installed.

The adaptor kit system is installed in the can 16 as shown in FIGS. 6 and 7. A screw-type "adaptor" 38 of the type discussed in FIG. 1 is threaded into the socket 32 of the can light in lieu of a conventional light bulb. A pair of wires W1 and W2 extend from the adaptor 38 and provide power as explained below.

The wing nuts 112 are loosened so that the brackets 114 can slide freely. Thereafter, the spider plate 102 and its attached brackets 114 are positioned within the interior of the can 16 and the heads of the can-height adjustment screws 30 passed through the slots 118 to "hang" the spider plate 102 on the can-height adjustment screws 30. In some cases, the original equipment screws may be too short and, in those cases, the installer can substitute longer screws for the original-equipment screws.

As best shown in FIG. 6, the "offset" discussed above in the context of the angle β creates an "offset" distance δ between the longitudinal axis of the screw 30 and the longitudinal axis of its adjustment screw 110. While the "offset" distance δ is a matter of choice, it is preferably large enough to allow the shaft of a screwdriver (or nut driver) to comfortably "clear" the adjustment screw 110 to engage the head of the screw 30 for tightening or loosening by the installer.

Once the brackets 114 are in place and their respective screws 30 tightened and the spider plate 102 "centered" in place, the adjustment screws 110 are adjusted to establish the distance "D" (FIG. 10) between the underside of the spider plate 102 and the to-be-installed mounting plate 122. Once the adjustment process is completed, the can-height adjustment screws 30 can be re-adjusted (if and/or as necessary) and the locking wing nuts tightened 112 to secure the spider plate 102 in place. While the adjustment screws 110 can be adjusted during the installation, as can be appreciated, the adjustment screws 110 can be pre-adjusted to a distance "D" prior to installation, as desired by the installer.

Once the spider plate 102 is installed in place, the mounting plate 124 is threaded onto the pipe 120 until the mounting plate 124 "bottoms" against or contacts the heads of the various adjustment screws 110; thereafter the mounting plate 124 is locked into position with a threaded sleeve 126 (or equivalent nut) to thus hold the mounting plate 124 in the plane defined by the heads of the adjustment screws 110.

The electrical wires W1 and W2 (FIG. 1) can be routed in at least two different ways depending the ultimate application. For example, the wires W1 and W2 can be passed through the interior of the threaded pipe 120 to extend from the bottom of the pipe, as shown in FIGS. 6 and 7. Alternatively, the wires W1 and W2 can be passed through the relatively large spaces between the legs of the spider plate 102. As can be appreciated by those skilled in the art, the three-leg configuration of the spider plate 102 allows access by the installer hand and fingers to the upper side of the spider plate 102 to position the wires W1 and W2 as desired.

With the mounting plate 124 secured in position, the cross-bar CB (shown in generic broken-line illustration in FIG. 7) is conventionally secured to the mounting plate 124 and the hardware supplied by the ceiling fan, hanging lamp, or flush-mount lamp, etc. to be installed.

The "offset" embodiment described above is the preferred form of the invention because of the clearance dimension δ that facilitates access by an appropriate screw or nut driver; however, other variants are suitable. For example and as shown in FIGS. 11–15, a non-offset version is presented in which the same reference characters refer to the same or similar parts.

Figure 11:
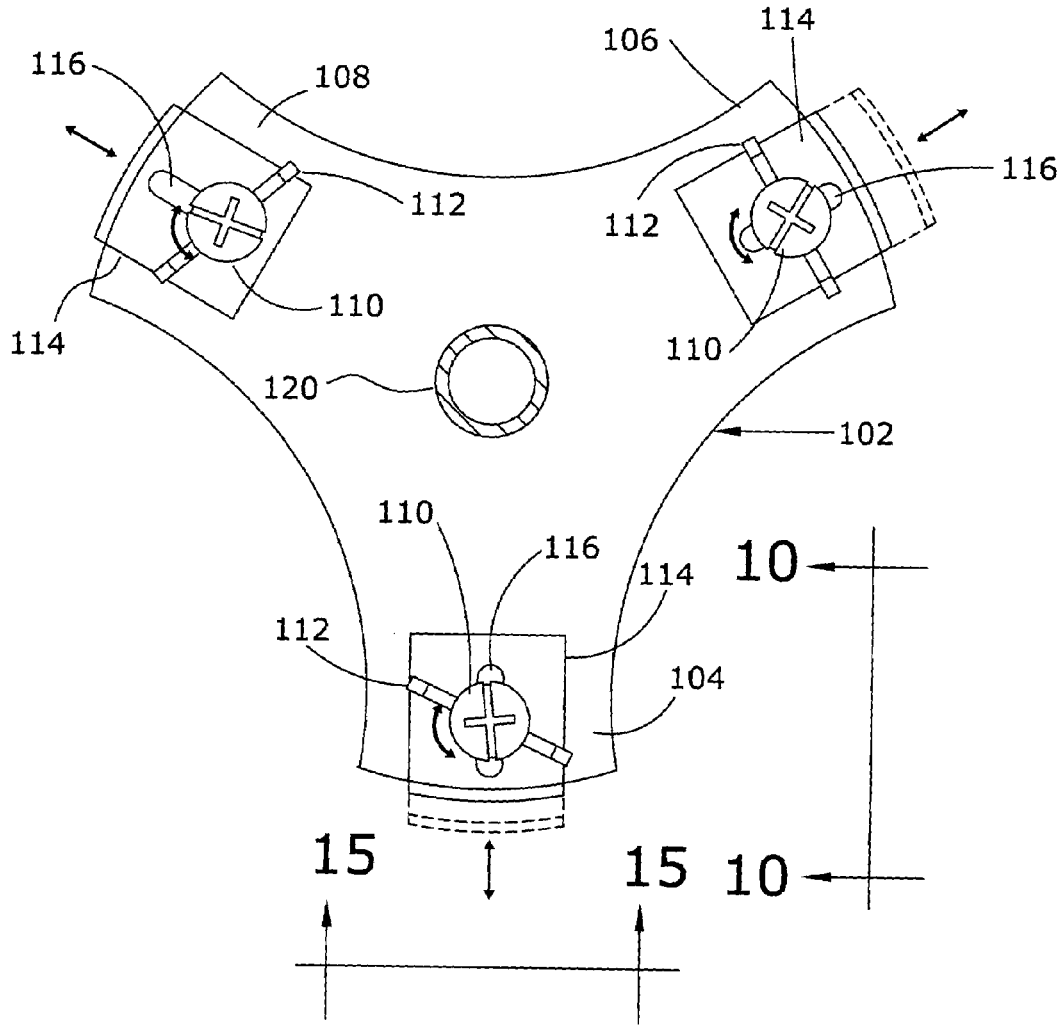
FIG. 11 is a bottom view of a second embodiment of the adaptor mounting plate system of the present invention.
Figure 12:
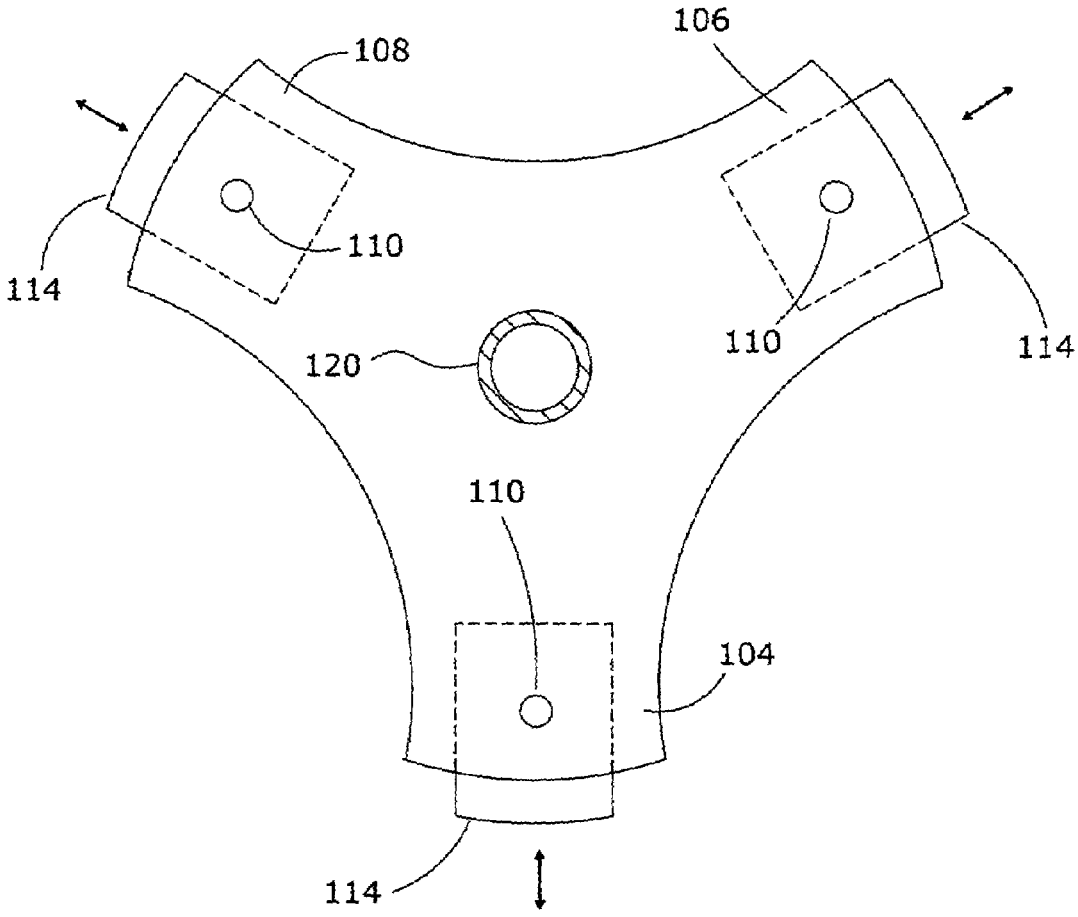
FIG. 12 is a top view of the second embodiment of the adaptor mounting plate system of FIG. 11.
Figure 13:
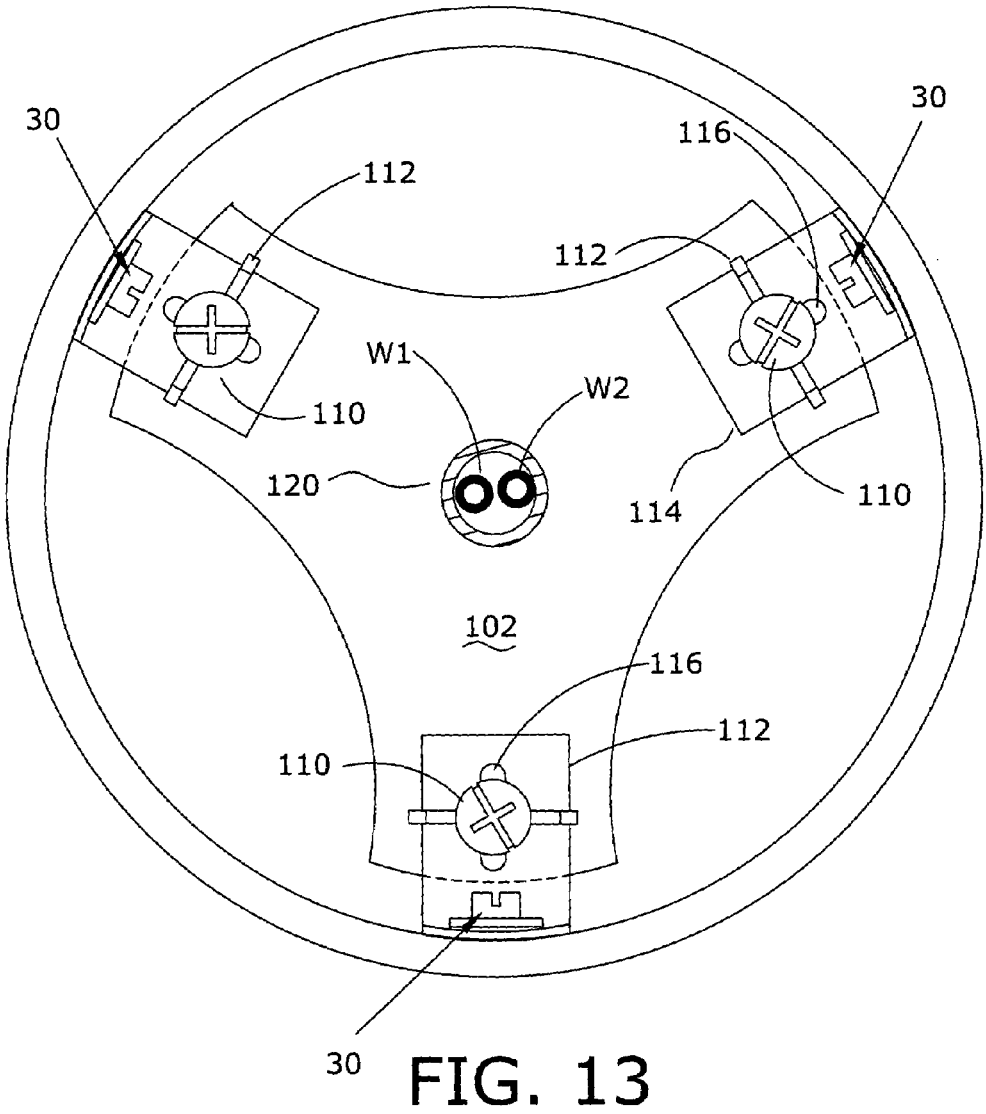
FIG. 13 is a bottom view of a can with the adaptor mounting plate system of FIGS. 11 and 12 installed.
Figure 14:
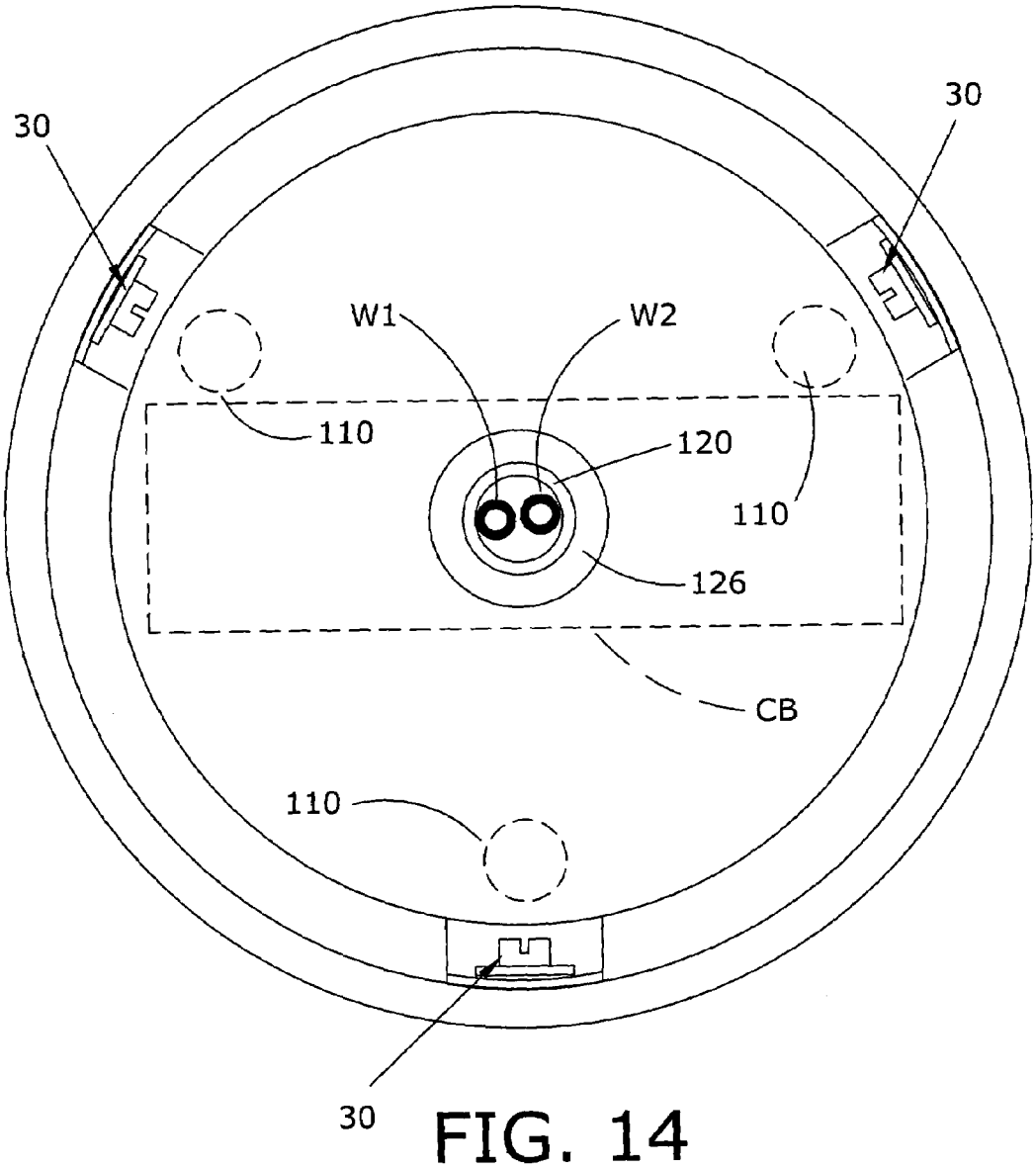
FIG. 14 is a bottom view of the can of FIG. 13 with a mounting plate installed.
Figure 15:
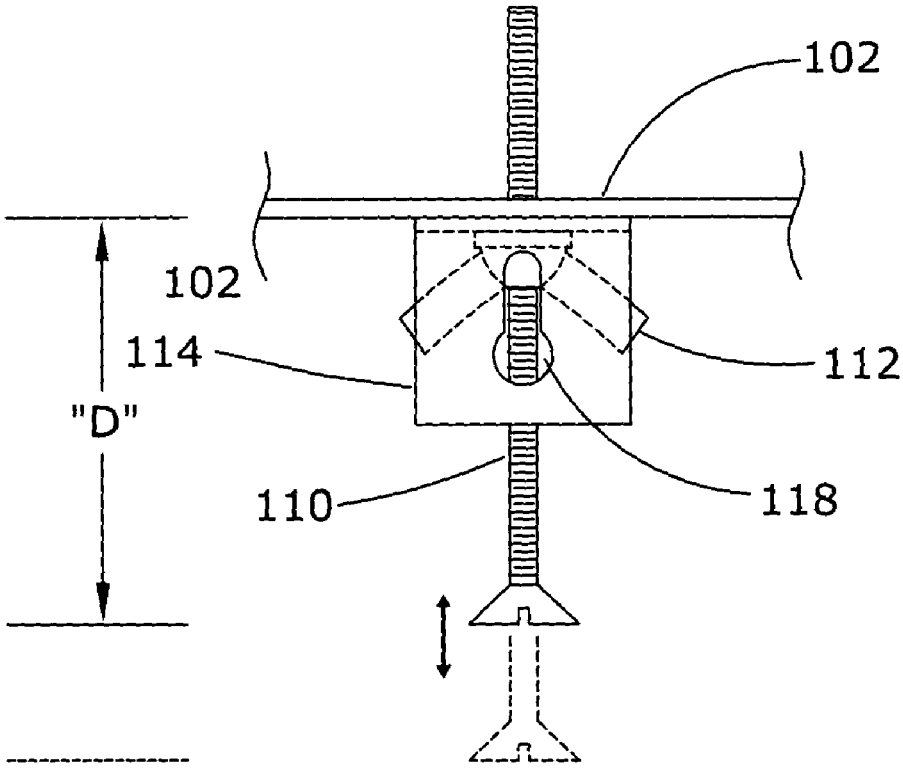
FIG. 15 is a detailed view of a second type of mounting leg taken along line 15—15 of FIG. 11.

As shown in FIGS. 11 and 12, the brackets 114 are not formed as "offset" brackets; the depending portion is bent at an angle of 90°. Consequently and as shown in FIG. 15, the threaded shank portion of the adjustment screw 110 is positioned directly behind the slot 118 to prevent access by a screwdriver or nutdriver shaft. However and while the "offset" of the first embodiment is not present, the can-height adjustment screws 30 can nonetheless be tightened or loosened using a open-end, box-end, racheting box-end wrench.

The present invention advantageously provides an adaptor kit system for use with can light assemblies to increase the usefulness of those assemblies by allowing the installation of various devices, including ceiling fans, hanging lamps, and/or flush-mount lamps or similar devices. While the preferred embodiments have been shown with a spider plate configuration, a spider plate equivalent can include an entirely circular plate having the brackets attached at equispaced positions about the periphery of the circular plate.

As will be apparent to those skilled in the art, various changes and modifications may be made to the illustrated embodiment of the present invention without departing from the spirit and scope of the invention as determined in the appended claims and their legal equivalent.

What is claimed is:

1. An adaptor kit for converting a can light of the type having an opening into an interior portion thereof defined by interior surfaces, the kit adapting the can light to accept auxiliary fixtures such as a ceiling fan, a hanging lamp, a flush-mounted lamp, the adaptor kit comprising:

a spider plate dimensioned for insertion into the interior portion of the can light and having at least three leg portions extending generally outwardly of a central area thereof;

a bracket mounted on each of said legs and positionally adjustable thereon at a selected position relative to the central area of the spider plate, said bracket having a portion thereof facing an interior surface of the can light for engagement therewith; and means associated with each bracket for securing its bracket in a selected position relative to its leg and for defining a plane spaced from the spider plate.

2. The adaptor kit of claim 1, wherein said means for securing comprises a threaded fastener having a first and second end, the first end thereof passing through an elongated slot in its bracket and into engagement with a hole in the spider plate and further comprising a threaded nut on said threaded fastener for clamping the bracket to the spider plate at a selected position thereon.

3. The adaptor kit of claim 2, wherein the second end of each of said threaded fasteners define said plane spaced from the spider plate.

4. The adaptor kit of claim 3, wherein said plane is substantially parallel to said spider plate.

5. The adaptor kit of claim 1, wherein each bracket is movable along an axis generally aligned at an angle relative to a radius line of the spider plate.

6. The adaptor kit of claim 5, wherein said angle is about 20°.

7. The adaptor kit of claim 1, wherein each of said brackets, on the portion thereof facing an interior surface of the can light for engagement therewith, includes an opening through which a fastener extends to positionally fix the position of the bracket to the interior surface of the can light.

8. The adaptor kit of claim 7, wherein said opening is a closed elongated slot, an open-ended slot, or a keyhole slot.

9. The adaptor kit of claim 1, further comprising an externally threaded pipe in engagement with a threaded hole in the central area of the spider plate.

10. The adaptor kit of claim 9, further comprising another plate, said another plate having a threaded hole therein for engagement with the threaded pipe and maintained in said plane spaced from said spider plate.

11. The adaptor kit of claim 10, wherein said another plate includes a plurality of threaded holes for engagement with an auxiliary electrical fixture.

12. The adaptor kit of claim 11, wherein said auxiliary electrical fixture is selected from the group consisting of a ceiling fan, a hanging lamp, a flush-mounted lamp.

13. The adaptor kit of claim 1, wherein a bracket is formed from a strip of metal having a major axis along the length thereof and having a first elongated hole therein and a slot therein and bent along a minor axis thereof intermediate the elongated hole and the slot at an angle relative to the major axis.

14. The adaptor kit of claim 13, wherein the angle of the minor axis relative to the major axis is about 20 degrees.

15. The adaptor kit of claim 1, wherein each of said brackets, on the portion thereof facing an interior surface of the can light for engagement therewith, includes an opening through which a fastener extends to positionally fix the position of the bracket to the interior surface of the can light.

16. An adaptor kit for converting a can light of the type having an opening into an interior portion thereof defined by interior surfaces, the kit adapting the can light to accept auxiliary fixtures such as a ceiling fan, a hanging lamp, a flush-mounted lamp, the adaptor kit comprising:

a support plate dimensioned for insertion into the interior portion of the can light;

at least three brackets mounted on the periphery of the support plate and spaced-apart from one another and each positionally adjustable thereon at a selected position relative to the central area of the support plate, said bracket having a portion thereof facing an interior surface of the can light for engagement therewith; and means associated with each bracket for securing its bracket in a selected position relative to the support plate and for defining a plane spaced from the support plate.

17. The adaptor kit of claim 16, wherein said means for securing comprises a threaded fastener having a first and second end, the first end thereof passing through an elongated slot in its bracket and into engagement with a hole in the support plate and further comprising a threaded nut on said threaded fastener for clamping the bracket to the support plate at a selected position thereon.

18. The adaptor kit of claim 17, wherein the second end of each of said threaded fasteners define said plane spaced from the support plate.

19. The adaptor kit of claim 18, wherein said plane is substantially parallel to said support plate.

20. The adaptor kit of claim 16, wherein each bracket is movable along an axis generally aligned at an angle relative to a radius line of the support plate.

* * * * *